US012109452B2

(12) United States Patent
Wang

(10) Patent No.: US 12,109,452 B2
(45) Date of Patent: Oct. 8, 2024

(54) ROWING MACHINE CAPABLE OF BEING FOLDED FOR STORAGE

(71) Applicant: Qiulin Wang, Longyan (CN)

(72) Inventor: Qiulin Wang, Longyan (CN)

( * ) Notice: Subject to any disclaimer, the term of this patent is extended or adjusted under 35 U.S.C. 154(b) by 0 days.

(21) Appl. No.: 17/913,828

(22) PCT Filed: Feb. 4, 2021

(86) PCT No.: PCT/CN2021/075322
§ 371 (c)(1),
(2) Date: Sep. 23, 2022

(87) PCT Pub. No.: WO2021/190177
PCT Pub. Date: Sep. 30, 2021

(65) Prior Publication Data

US 2024/0216750 A1 Jul. 4, 2024

(30) Foreign Application Priority Data

Mar. 24, 2020 (CN) ..... 202020389092.8

(51) Int. Cl.
*A63B 22/00* (2006.01)

(52) U.S. Cl.
CPC ..... *A63B 22/0076* (2013.01); *A63B 2209/08* (2013.01); *A63B 2210/50* (2013.01)

(58) Field of Classification Search
CPC ..... A63B 2209/08; A63B 23/03566; A63B 21/4043; A63B 71/04; A63B 21/4034;
(Continued)

(56) References Cited

U.S. PATENT DOCUMENTS 1,727,657 A * 9/1929 Martin ..... A63B 22/0076 74/531
5,683,195 A * 11/1997 Liao ..... B62B 1/045 280/DIG. 6

(Continued)

FOREIGN PATENT DOCUMENTS

CN 204637410 U * 9/2015
CN 208893641 U * 5/2019
CN 209405576 U * 9/2019

OTHER PUBLICATIONS

ISR of PCT/CN2021/075322.

*Primary Examiner* — Garrett K Atkinson
(74) *Attorney, Agent, or Firm* — Hemisphere Law, PLLC; Zhigang Ma

(57) ABSTRACT

The present disclosure relates to the technical field of gym equipment, in particular, to a novel rowing machine capable of being folded for storage, including a first bottom frame and a second bottom frame which are hinged to each other, wherein a bottom of the second bottom frame is folded to be fitted to a bottom of the first bottom frame; side surfaces of the first bottom frame and the second bottom frame are correspondingly provided with a first pillar and a rotatable handle; the rotatable handle is hinged to the side surface of the second bottom frame; the rotatable handle is rotated to be clamped with the first stop pillar to prevent the folded first bottom frame and second bottom frame from being unfolded; the rotatable handle is further in threaded connection with a screwing piece; and the screwing piece is rotated to drive the rotatable handle to move to lock and fix the folded first bottom frame and second bottom frame. By means of the arrangement of the first bottom frame and the second bottom frame which are hinged to each other, the rowing machine is foldable, so that an occupied space is reduced, and it is convenient to place and store the rowing
(Continued)

machine after exercise. The first stop pillar and the rotatable handle are locked to each other through the screwing piece to prevent the folded first bottom frame and the second bottom frame from being accidentally unfolded, thereby avoiding a damage.

13 Claims, 4 Drawing Sheets

(58) Field of Classification Search
CPC ..... A63B 21/00192; A63B 23/03525; A63B 21/02; A63B 21/154; A63B 22/0076; A63B 21/4035; A63B 21/0628; A63B 2210/06; A63B 21/169; A63B 2071/024; A63B 22/0048; A63B 22/0087; A63B 2022/0079; A63B 2210/50; A63B 22/0056; A63B 21/156; A63B 21/1672; A63B 21/4029; A63B 21/151; A63B 2210/00

See application file for complete search history.

(56) References Cited

U.S. PATENT DOCUMENTS

| | | | | |
|---|---|---|---|---|
| 9,750,972 | B1 * | 9/2017 | Liu | A63B 22/20 |
| 2003/0119635 | A1 * | 6/2003 | Arbuckle | A63B 23/0405 482/142 |
| 2005/0272568 | A1 * | 12/2005 | Wang | A63B 22/0076 482/72 |
| 2006/0148622 | A1 * | 7/2006 | Chen | A63B 21/153 482/121 |
| 2008/0248935 | A1 * | 10/2008 | Solow | A63B 21/154 482/142 |
| 2012/0283079 | A1 * | 11/2012 | Solow | A63B 21/00065 482/142 |
| 2013/0244838 | A1 * | 9/2013 | Jheng | A63B 22/04 482/52 |
| 2017/0291056 | A1 * | 10/2017 | Hsu | A63B 21/0442 |
| 2018/0036620 | A1 * | 2/2018 | Thostrup | A63B 71/145 |
| 2018/0178057 | A1 * | 6/2018 | Fowler | A63B 21/4043 |
| 2018/0280752 | A1 * | 10/2018 | Duval | A63B 23/0458 |
| 2019/0111302 | A1 * | 4/2019 | Ballestero | A63B 23/0211 |
| 2019/0381350 | A1 * | 12/2019 | I-Heng | A63B 21/0088 |
| 2023/0077418 | A1 * | 3/2023 | Qiu | A63B 21/15 482/72 |

* cited by examiner

ROWING MACHINE CAPABLE OF BEING FOLDED FOR STORAGE

CROSS-REFERENCE TO RELATED APPLICATION

This application refers to China Patent Application No. 202020389092.8, filed on Mar. 24, 2020 and entitled "Novel Rowing Machine Capable of Being Folded for Storage", which is incorporated by reference herein in its entirety.

TECHNICAL FIELD

The present disclosure relates to the technical field of gym equipment, in particular, to a novel rowing machine capable of being folded for storage.

BACKGROUND

As people pay more and more attention to their health, proper exercises and fitness are also essential in addition to a reasonable diet and adequate sleep. In order to keep exercise and fitness as effective daily behaviors for a long time, and to avoid being affected by weather conditions and other factors as much as possible, most people use gym equipment to do exercises, so that people can do physical exercises at home.

Most sets of gym equipment achieve a strength-enhancing exercise effect mainly by setting different resistances. For example, a rowing machine is a kind of aerobic exercise apparatus that can improve the comprehensive abilities. Using the rowing machine to do exercise is like kayaking. During exercise time, muscles of the legs, the waist, the upper limbs and the back part work within short time due to the resistance of water and changes in the rotating speed of a rotating wheel.

However, during use, a traditional rowing machine is flatly placed on the ground, is relatively long, occupies a large area, cannot be folded for storage, and is not favorable for movement and storage. In order to solve this problem, Patent No. CN209405576U filed on Sep. 20, 2019 and entitled "Foldable Liquid Resistance Rowing Machine for Exercise" discloses a foldable liquid resistance rowing machine for exercise. A main frame bottom plate I is arranged on one side of a lower part of a main frame; a main frame bottom plate II is arranged on one side of the main frame bottom plate I; and the main frame bottom plate I and the main frame bottom plate II are connected through a folding part. The folding part is arranged between the main frame bottom plate I and the main frame bottom plate II, so that it is convenient to move and store the rowing machine.

Although the rowing machine can be folded and stored in the above scheme, the rowing machine is easily recovered to a spread state since wheels arranged at a bottom of the rowing machine move easily. Furthermore, if the rowing machine with a heavy weight slides to recover the spread state by its own, an extremely high impact force will be caused, and the rowing machine is easy to damage.

SUMMARY

Technical Problem

The existing rowing machine is easily recovered to the spread state after being folded and stored.

Technical Solution

The present disclosure provides a novel rowing machine capable of being folded for storage, including a first bottom frame and a second bottom frame which are hinged to each other, wherein a bottom of the second bottom frame is folded to be fitted to a bottom of the first bottom frame.

On the basis of the above structure, further, rollers are arranged at bottoms of ends, away from each other, of the first bottom frame and the second bottom frame.

On the basis of the above structure, further, a folding handle is further arranged at an end of the second bottom frame hinged to the first bottom frame.

On the basis of the above structure, further, one end of the first bottom frame close to the second bottom frame is provided with a fixed plate used for mounting a hinged shaft; and the fixed plate extends, relative to an end surface of the first bottom frame, to the outside to form a bulge.

On the basis of the above structure, further, combining end surfaces of the first bottom frame and the second bottom frame are sequentially composed of a vertical section and an inclined section from top to bottom.

On the basis of the above structure, further, the first bottom frame and the second bottom frame are correspondingly provided with fixing assemblies to prevent the folded first bottom frame and second bottom frame from being unfolded.

On the basis of the above structure, further, the fixing assemblies include a first stop pillar and a rotatable handle which are matched with each other; the rotatable handle is hinged to a side surface of the second bottom frame; and the rotatable handle is rotated to be matched with the first stop pillar to prevent the folded first bottom frame and second bottom frame from being unfolded.

On the basis of the above structure, further, a side surface of the second bottom frame is further provided with a second stop pillar; and materials of the rotatable handle and the second stop pillar are magnetic materials attracting each other, so that one end of the rotatable handle is fixed on the second stop pillar.

On the basis of the above structure, further, the rotatable handle is hinged to the second bottom frame through a mounting shaft; one end of the mounting shaft passes through a mounting hole in the rotatable handle and is fixed on the second bottom frame, and the other end is provided with a baffle plate for preventing the rotatable handle from falling off.

On the basis of the above structure, further, the mounting shaft is fixedly connected to the second bottom frame through a thread.

On the basis of the above structure, further, the rotatable handle is further in threaded connection with a screwing piece; and the screwing piece is rotated to drive the rotatable handle to move, so that the folded first bottom frame and second bottom frame are locked and fixed to each other.

On the basis of the above structure, further, the screwing piece is a hand bolt.

On the basis of the above structure, further, an axial direction of the screwing piece is parallel to a lengthwise direction of the rotatable handle; and one end of the screwing piece is in contact with the mounting shaft, so that the screwing piece is rotated in situ.

On the basis of the above structure, further, the bottom of the first bottom frame and the bottom of the second bottom frame are correspondingly provided with magnetic plates attracting each other.

On the basis of the above structure, further, the bottom of the first bottom frame and the bottom of the second bottom frame are provided with buffer devices.

On the basis of the above structure, further, the buffer device is a spring, a sponge pad or a rubber pad.

Beneficial Effects

The present disclosure provides a novel rowing machine capable of being folded for storage. By the arrangement of the first bottom frame and the second bottom frame which are hinged to each other, the rowing machine is foldable, so that an occupied space is reduced, and it is convenient to place and store the rowing machine after exercise.

BRIEF DESCRIPTION OF THE DRAWINGS

To describe the embodiments of the present disclosure or the technical solutions in the existing art more clearly, drawings required to be used in the embodiments or the illustration of the existing art will be briefly introduced below. Obviously, the drawings in the illustration below are some embodiments of the present disclosure. Those ordinarily skilled in the art also can acquire other drawings according to the provided drawings without doing creative work.

REFERENCE NUMERALS IN THE DRAWINGS

100: first bottom frame; 110: first stop pillar; 200: second bottom frame;

210: rotatable handle; 211: screwing piece; 212: mounting hole;

213: clamping jaw; 220: second stop pillar; 230: folding handle;

240: mounting shaft; 250: roller; 260: fixed plate

DETAILED DESCRIPTION OF THE EMBODIMENTS

Optimal Implementations of the Present Disclosure

Figure 1:
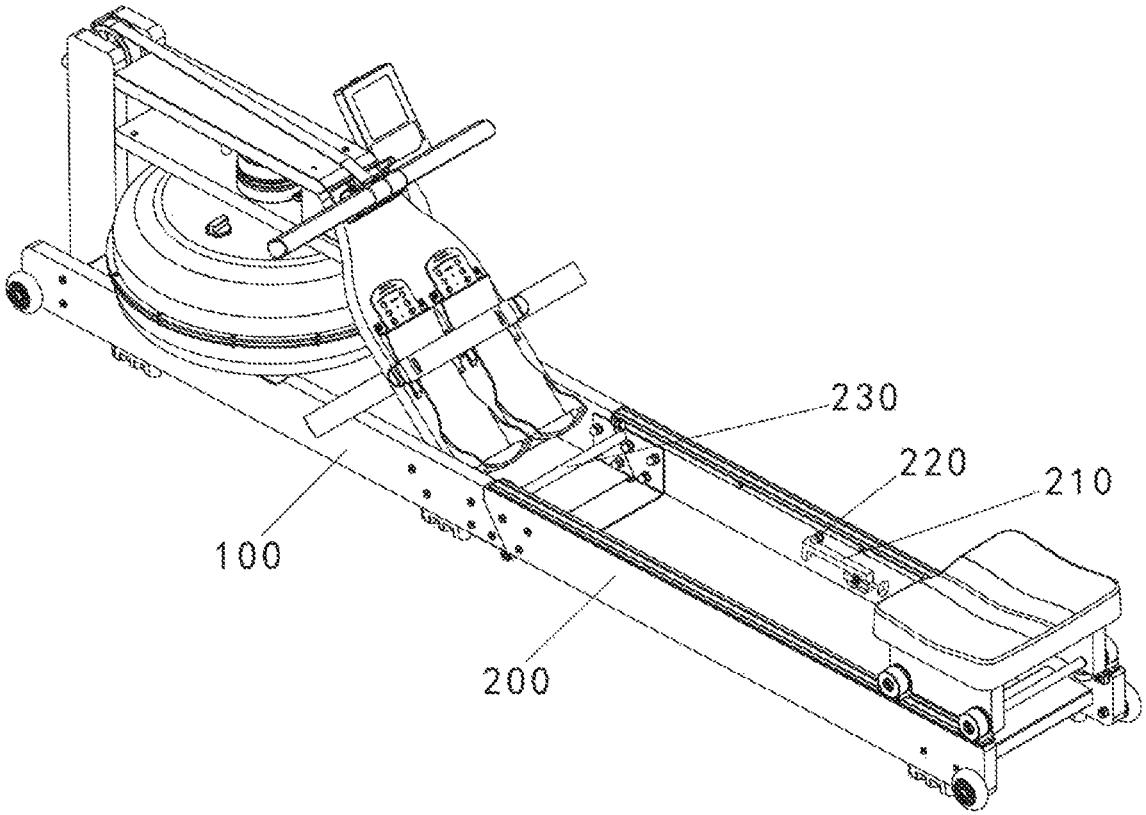
FIG. 1 is a schematic diagram of a novel rowing machine capable of being folded for storage provided according to the present disclosure in an unfolded state.
Figure 2:
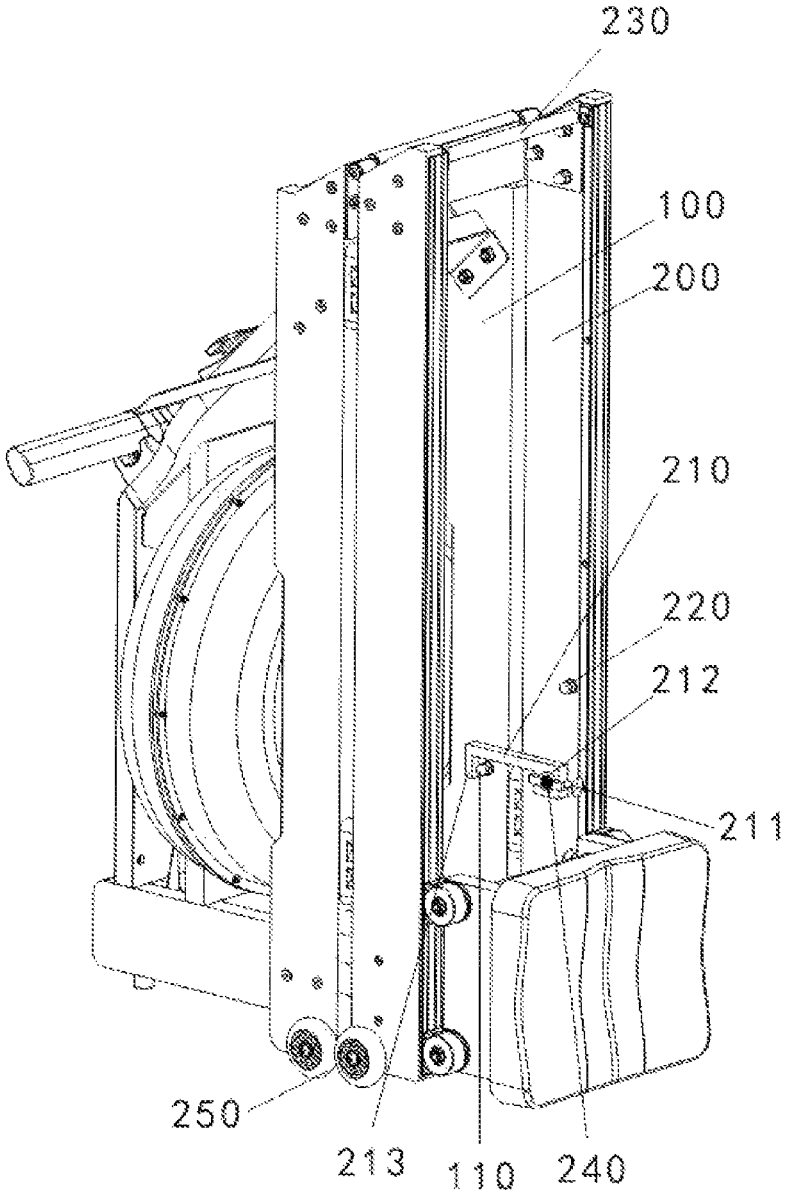
FIG. 2 is a schematic diagram (I) of a novel rowing machine capable of being folded for storage provided according to the present disclosure in a folded state.

During specific implementation, as shown in FIG. 1 and FIG. 2, a novel rowing machine capable of being folded for storage includes a first bottom frame 100 and a second bottom frame 200 which are hinged to each other. Specifically, the first bottom frame 100 and the second bottom frame 200 are hinged through a pin shaft. A water resistor is arranged on the first bottom frame 100, and a seat is arranged on the second bottom frame 200. The seat may slide on the second bottom frame 200 in a reciprocating manner. The second bottom frame 200 may be folded along a hinged part with the first bottom frame 100 until the bottoms of the two frames are close and fitted to each other. That is, the second bottom frame 200 may rotate 180 degrees relative to the first bottom frame 100 to achieve a folding effect, so that the occupied space is reduced, and it is convenient to place and store the rowing machine after exercise.

Implementations of the Present Disclosure

In order to make the objectives, technical solutions and advantages of the embodiments of the present disclosure clearer, the technical solutions in the embodiments of the present disclosure will be described clearly and completely below in combination with the drawings in the embodiments of the present disclosure. Obviously, the embodiments described herein are part of the embodiments of the present disclosure, not all the embodiments. Based on the embodiments in the present disclosure, all other embodiments obtained by those of ordinary skill in the art without doing creative work shall fall within the protection scope of the present disclosure.

In the description of the present disclosure, it should be noted that orientations or positional relationships indicated by the terms "center", "longitudinal", "transverse", "upper", "lower", "front", "rear", "left", "right", "vertical", "horizontal", "top", "bottom", "inside", "outside" and the like are orientations or positional relationships as shown in the drawings, and are only for the purpose of facilitating and simplifying the description of the present disclosure instead of indicating or implying that devices or elements indicated must have particular orientations, and be constructed and operated in the particular orientations, so that these terms are construed as limiting the present disclosure. In addition, the terms "first" and "second" are only for the purpose of description, and may not be understood as indicating or implying the relative importance.

The present disclosure provides a novel rowing machine capable of being folded for storage, including a first bottom frame 100 and a second bottom frame 200 which are hinged to each other, wherein a bottom of the second bottom frame 200 is folded to be fitted to a bottom of the first bottom frame 100.

During specific implementation, as shown in FIG. 1 and FIG. 2, a novel rowing machine capable of being folded for storage includes a first bottom frame 100 and a second bottom frame 200 which are hinged to each other. Specifically, the first bottom frame 100 and the second bottom frame 200 are hinged through a pin shaft. A water resistor is arranged on the first bottom frame 100, and a seat is arranged on the second bottom frame 200. The seat may slide on the second bottom frame 200 in a reciprocating manner. The second bottom frame 200 may be folded along a hinged part with the first bottom frame 100 until the bottoms of the two frames are close and fitted to each other. That is, the second bottom frame 200 may rotate 180 degrees relative to the first bottom frame 100 to achieve a folding effect, so that the occupied space is reduced, and it is convenient to place and store the rowing machine after exercise.

The present disclosure provides a novel rowing machine capable of being folded for storage. By the arrangement of the first bottom frame and the second bottom frame which are hinged to each other, the rowing machine is foldable, so that an occupied space is reduced, and it is convenient to place and store the rowing machine after exercise.

Preferably, rollers 250 are arranged at bottoms of ends, away from each other, of the first bottom frame 100 and the second bottom frame 200.

During specific implementation, as shown in FIG. 1 and FIG. 2, the rollers 250 are arranged at the bottoms of the ends, away from each other, of the first bottom frame 100 and the second bottom frame 200, so that it is conductive to folding and unfolding the first bottom frame 100 and the second bottom frame 200.

Preferably, a folding handle 230 is further arranged at an end of the second bottom frame 200 hinged to the first bottom frame 100.

During specific implementation, as shown in FIG. 1 and FIG. 2, the folding handle 230 is further arranged at the end of the second bottom frame 200 hinged to the first bottom frame 100. Specifically, the folding handle 230 is cylindrical, which facilitates holding with a hand. During folding, the folding handle 230 is pulled to enable the second bottom frame 200 and the first bottom frame 100 to be close to each other, thereby achieving the folding effect and improving the convenience of folding.

Preferably, one end of the first bottom frame 100 close to the second bottom frame 200 is provided with a fixed plate 260 used for mounting a hinged shaft; and the fixed plate 260 extends, relative to an end surface of the first bottom frame 100, to the outside to form a bulge.

Figure 3:
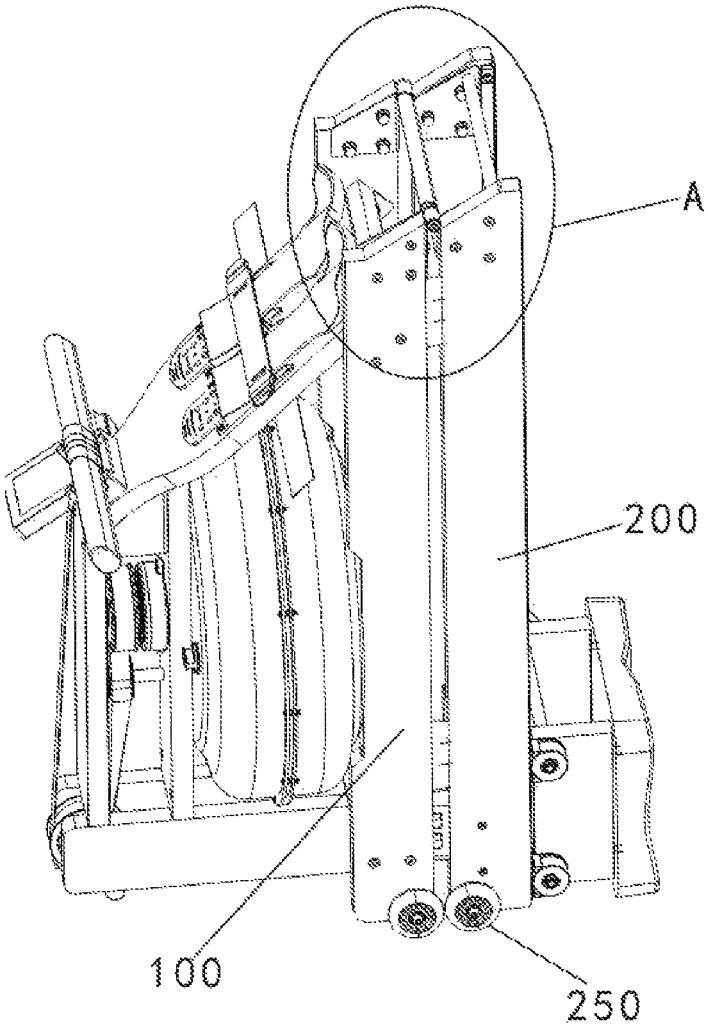
FIG. 3 is a schematic diagram (II) of a novel rowing machine capable of being folded for storage provided according to the present disclosure in a folded state.
Figure 4:
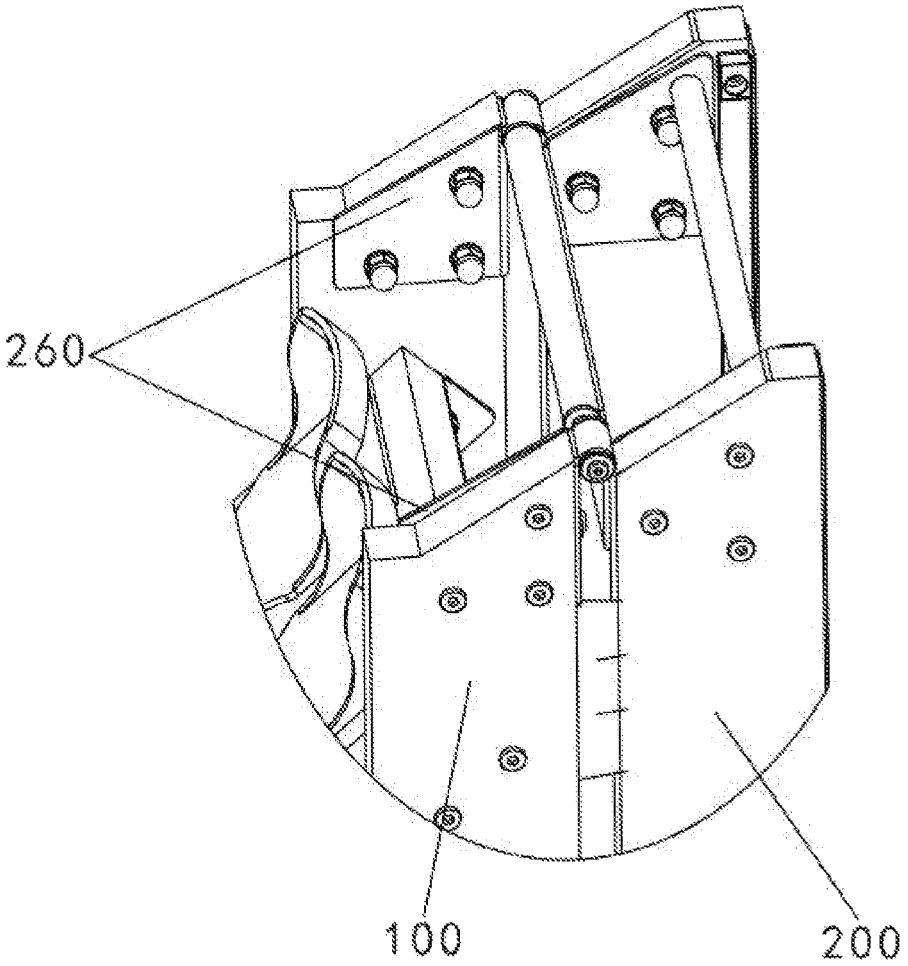
FIG. 4 is a schematic enlarged diagram of the part A in FIG. 3.

During specific implementation, as shown in FIG. 3 and FIG. 4, the end of the first bottom frame 100 close to the second bottom frame 200 is provided with the fixed plate 260 used for mounting a hinged shaft; and the fixed plate 260 extends, relative to the end surface of the first bottom frame 100, to the outside to form the bulge. That is, the fixed plate 260 is slightly higher than the end surface of the first bottom frame 100. During unfolding, the end surfaces of the second bottom frame 200 and the first bottom frame 100 can be accurately engaged to achieve a correcting and positioning effect.

Preferably, combining end surfaces of the first bottom frame 100 and the second bottom frame 200 are sequentially composed of a vertical section and an inclined section from top to bottom.

During specific implementation, as shown in FIG. 1-FIG. 4, the combining end surfaces of the first bottom frame 100 and the second bottom frame 200 are sequentially composed of the vertical section and the inclined section from top to bottom. By the adoption of the sections of this structure, when the folding handle 230 is lifted up, two ends of the rowing machine can be prevented from upwarping, which is conductive to natural folding of the first bottom frame 100 and the second bottom frame 200. If only the vertical section is used, when the folding handle 230 is lifted up, the end away from the folding handle 230 easily upwarps, which is not favorable for folding.

Preferably, the first bottom frame 100 and the second bottom frame 200 are correspondingly provided with fixing assemblies to prevent the folded first bottom frame 100 and second bottom frame 200 from being unfolded.

During specific implementation, the side surfaces of the first bottom frame 100 and the second bottom frame 200 are correspondingly provided with the fixing assemblies to prevent the folded first bottom frame and second bottom frame from being unfolded, thus avoiding a damage.

Preferably, the fixing assemblies include a first stop pillar 110 and a rotatable handle 210 which are matched with each other; the rotatable handle 210 is hinged to a side surface of the second bottom frame 200; and the rotatable handle 210 is rotated to be matched with the first stop pillar 110 to prevent the folded first bottom frame 100 and second bottom frame 200 from being unfolded.

During specific implementation, as shown in FIG. 1 and FIG. 2, the fixing assemblies include the first stop pillar 110 and the rotatable handle 210 which are matched with each other. Inner side surfaces of the first bottom frame 100 and second bottom frame 200 are correspondingly provided with the first stop pillar 110 and the rotatable handle 210. The rotatable handle 210 is hinged to the inner side surface of the second bottom frame 200. Specifically, the rotatable handle 210 is hinged to the second bottom frame 200 through a mounting shaft 240; one end of the mounting shaft 240 passes through a mounting hole 212 in the rotatable handle 210 and is fixed on the second bottom frame 200, and the other end is provided with a baffle plate for preventing the rotatable handle 210 from falling off. Specifically, the mounting shaft 240 is fixed on the second bottom frame 200 through a thread.

The rotatable handle 210 is rotated to be clamped with the first stop pillar 110. Specifically, an end of the rotatable handle 210 that is in contact with the first stop pillar 110 is provided with an "L"-shaped clamping jaw 213 to prevent the folded first bottom frame 100 and the second bottom frame 200 from being unfolded.

The first stop pillar and the rotatable handle are correspondingly arranged on the side surfaces of the first bottom frame and the second bottom frame. The rotatable handle and the first stop pillar are clamped with each other to prevent the folded first bottom frame and the second bottom frame from being accidentally unfolded, thereby avoiding a damage.

Preferably, a side surface of the second bottom frame 200 is further provided with a second stop pillar 220; and materials of the rotatable handle 210 and the second stop pillar 220 are magnetic materials attracting each other, so that one end of the rotatable handle 210 is fixed on the second stop pillar 220.

During specific implementation, as shown in FIG. 1, an inner side surface of the second bottom frame 200 is further provided with the second stop pillar 220; the materials of the rotatable handle 210 and the second stop pillar 220 are the magnetic materials attracting each other, so that one end of the rotatable handle 210 is fixed on the second stop pillar 220. When the first bottom frame 100 and the second bottom frame 200 are in a spread state, the rotatable handle 210 can be rotated to enable one end of the rotatable handle to be magnetically sucked on the second stop pillar 220 to achieve fixing, thereby avoiding random swinging of the rotatable handle 210.

Preferably, the rotatable handle 210 is further in threaded connection with a screwing piece 211; and the screwing piece 211 is rotated to drive the rotatable handle 210 to move, so that the folded first bottom frame 100 and second bottom frame 200 are locked and fixed to each other.

During specific implementation, as shown in FIG. 1 and FIG. 2, the rotatable handle 210 is further in threaded connection with the screwing piece 211. The screwing piece 211 is arranged at an end of the rotatable handle 210 away from the clamping jaw 213, and an axial direction of the screwing piece is parallel to a lengthwise direction of the rotatable handle 210. A radius of the mounting hole 212 is greater than that of the mounting shaft 240, so that there is a moving space for the rotating handle 210 in a radial direction of the mounting shaft 240. One end of the screwing piece 211 is in contact with the mounting shaft 240, so that the screwing piece 211 may be rotated in situ. The screwing piece 211 is in threaded connection with the rotatable handle 210, so that the in-situ rotation of the screwing piece 211 will drive the rotatable handle 210 to radially move until the rotatable handle 210 and the first stop pillar 110 are tightly clamped. During carrying of the folded rowing machine, it is hard for the rotatable handle 210 to be separated from the first stop pillar 110, so that the folded first bottom frame 100 and second bottom frame 200 are locked and fixed to each other to prevent the folded first bottom frame 100 and second bottom frame 200 from being accidentally unfolded, thereby avoiding a damage.

Preferably, the screwing piece 211 is a hand bolt.

During specific implementation, the screwing piece 211 is the hand bolt. Compared with an ordinary bolt which needs to be screwed down for use by a screwdriver or other tools, the hand bolt can be directly screwed down with a hand for use to achieve a fastening process. No tool is used, and the convenience of locking is improved.

Preferably, the bottom of the first bottom frame 100 and the bottom of the second bottom frame 200 are correspondingly provided with magnetic plates attracting each other.

During specific implementation, the bottom of the first bottom frame 100 and the bottom of the second bottom frame 200 are correspondingly provided with the magnetic plates attracting each other, so that the firmness of combination of the bottom of the first bottom frame 100 and the bottom of the second bottom frame 200 during folding is further increased, thereby preventing the first bottom frame 100 and the second bottom frame 200 from being accidentally unfolded.

Preferably, the bottom of the first bottom frame 100 and the bottom of the second bottom frame 200 are provided with buffer devices.

During specific implementation, the bottom of the first bottom frame 100 and the bottom of the second bottom frame 200 are provided with the buffer devices, so as to reduce an impact force generated by unfolding and falling of the first bottom frame 100 and the second bottom frame 200 and avoid a damage to equipment. Specifically, each buffer device is an elastic material, such as a spring, a sponge pad or a rubber pad.

Many terms such as bottom frame, stop pillar, rotatable handle, screwing piece, and folding handle are used herein, but the possibility of using other terms is not excluded. These terms are used only to more conveniently describe and explain the essence of the present disclosure; and it is contrary to the spirit of the present disclosure to interpret them as any kind of additional limitations.

It should be finally noted that the above various embodiments are only used to describe the technical solutions of the present disclosure, and not intended to limit the present disclosure. Although the present disclosure has been described in detail with reference to the foregoing embodiments, those ordinarily skilled in the art should understand that they can still modify the technical solutions described in all the foregoing embodiments, or equivalently replace some or all of the technical features, and these modifications or replacements do not depart the essences of the corresponding technical solutions from the spirit and scope of the technical solutions of all the embodiments of the present disclosure.

INDUSTRIAL PRACTICABILITY

A novel rowing machine capable of being folded for storage includes a first bottom frame and a second bottom frame which are hinged to each other, wherein a bottom of the second bottom frame is folded to be fitted to a bottom of the first bottom frame; side surfaces of the first bottom frame and the second bottom frame are correspondingly provided with a first pillar and a rotatable handle; the rotatable handle is hinged to the side surface of the second bottom frame; the rotatable handle is rotated to be clamped with the first stop pillar to prevent the folded first bottom frame and second bottom frame from being unfolded; the rotatable handle is further in threaded connection with a screwing piece; and the screwing piece is rotated to drive the rotatable handle to move to lock and fix the folded first bottom frame and second bottom frame. By means of the arrangement of the first bottom frame and the second bottom frame which are hinged to each other, the rowing machine is foldable, so that an occupied space is reduced, and it is convenient to place and store the rowing machine after exercise. The first stop pillar and the rotatable handle are locked to each other through the screwing piece to prevent the folded first bottom frame and the second bottom frame from being accidentally unfolded, thereby avoiding a damage.

What is claimed is:

1. A novel rowing machine capable of being folded for storage, comprising a first bottom frame (100) and a second bottom frame (200) which are hinged to each other, wherein a bottom of the second bottom frame (200) is folded to be fitted to a bottom of the first bottom frame (100);

wherein the first bottom frame (100) and the second bottom frame (200) are correspondingly provided with fixing assemblies to prevent the folded first bottom frame (100) and second bottom frame (200) from being unfolded;

wherein the fixing assemblies comprise a first stop pillar (110) and a rotatable handle (210) which are matched with each other; the rotatable handle (210) is hinged to a side surface of the second bottom frame (200); and the rotatable handle (210) is rotated to be matched with the first stop pillar (110) to prevent the folded first bottom frame (100) and second bottom frame (200) from being unfolded; and wherein a side surface of the second bottom frame (200) is further provided with a second stop pillar (220); and materials of the rotatable handle (210) and the second stop pillar (220) are magnetic materials attracting each other, so that one end of the rotatable handle (210) is fixed on the second stop pillar (220).

2. The rowing machine capable of being folded for storage according to claim 1, wherein rollers (250) are arranged at bottoms of ends, away from each other, of the first bottom frame (100) and the second bottom frame (200).

3. The rowing machine capable of being folded for storage according to claim 1, wherein a folding handle (230) is further arranged at an end of the second bottom frame (200) hinged to the first bottom frame (100).

4. The rowing machine capable of being folded for storage according to claim 1, wherein one end of the first bottom frame (100) close to the second bottom frame (200) is provided with a fixed plate (260) used for mounting a hinged shaft; and the fixed plate (260) extends, relative to an end surface of the first bottom frame (100), to the outside to form a bulge.

5. The rowing machine capable of being folded for storage according to claim 1, wherein combining end surfaces of the first bottom frame (100) and the second bottom frame (200) are sequentially composed of a vertical section and an inclined section from top to bottom.

6. The rowing machine capable of being folded for storage according to claim 1, wherein the rotatable handle (210) is hinged to the second bottom frame (200) through a mounting shaft (240); one end of the mounting shaft (240) passes through a mounting hole (212) in the rotatable handle (210) and is fixed on the second bottom frame (200), and the other end is provided with a baffle plate for preventing the rotatable handle (210) from falling off.

7. The rowing machine capable of being folded for storage according to claim 6, wherein the mounting shaft (240) is fixedly connected to the second bottom frame (200) through a thread.

8. The rowing machine capable of being folded for storage according to claim 1, wherein the rotatable handle (210) is further in threaded connection with a screwing piece (211); and the screwing piece (211) is rotated to drive the rotatable handle (210) to move, so that the folded first bottom frame (100) and second bottom frame (200) are locked and fixed to each other.

9. The rowing machine capable of being folded for storage according to claim 8, wherein the screwing piece (211) is a hand bolt.

10. The rowing machine capable of being folded for storage according to claim 8, wherein an axial direction of the screwing piece (211) is parallel to a lengthwise direction of the rotatable handle (210); and one end of the screwing piece (211) is in contact with the mounting shaft (240), so that the screwing piece (211) is rotated in situ.

11. The rowing machine capable of being folded for storage according to claim 1, wherein the bottom of the first bottom frame (100) and the bottom of the second bottom frame (200) are correspondingly provided with magnetic plates attracting each other.

12. The rowing machine capable of being folded for storage according to claim 1, wherein the bottom of the first bottom frame (100) and the bottom of the second bottom frame (200) are provided with buffer devices.

13. The rowing machine capable of being folded for storage according to claim 12, wherein the buffer device is a spring, a sponge pad or a rubber pad.

* * * * *